US009105991B1

(12) United States Patent
Bliss

(10) Patent No.: US 9,105,991 B1
(45) Date of Patent: Aug. 11, 2015

(54) CRIMPLESS ELECTRICAL CONNECTOR ASSEMBLY

(71) Applicant: Steve W. Bliss, Port Charlotte, FL (US)

(72) Inventor: Steve W. Bliss, Port Charlotte, FL (US)

( * ) Notice: Subject to any disclaimer, the term of this patent is extended or adjusted under 35 U.S.C. 154(b) by 132 days.

(21) Appl. No.: 13/654,042

(22) Filed: Oct. 17, 2012

(51) Int. Cl.
*H01R 4/24* (2006.01)
*H01R 4/48* (2006.01)

(52) U.S. Cl.
CPC ..... *H01R 4/4818* (2013.01); *H01R 4/4827* (2013.01)

(58) Field of Classification Search
CPC .. H01R 4/4818; H01R 4/4827; H01R 4/4836; H01R 2103/00; H01R 9/093
USPC ..... 439/441, 439, 440, 733.1
See application file for complete search history.

(56) References Cited

U.S. PATENT DOCUMENTS

| | | | | |
|---|---|---|---|---|
| D309,129 | S | 7/1990 | Ottmann | |
| 4,978,315 | A * | 12/1990 | Edgley et al. | 439/441 |
| 5,110,305 | A * | 5/1992 | Edgley et al. | 439/441 |
| 5,403,201 | A | 4/1995 | McCarthy | |
| 5,454,730 | A * | 10/1995 | Tozuka | 439/438 |
| 5,791,919 | A | 8/1998 | Brisson et al. | |
| 5,847,320 | A | 12/1998 | Fisher | |
| 5,890,925 | A | 4/1999 | Bernardini | |
| 6,280,233 | B1 * | 8/2001 | Beege et al. | 439/441 |
| 6,341,979 | B1 | 1/2002 | Yamamoto | |
| 6,722,902 | B2 | 4/2004 | Kedzierski | |
| 6,746,286 | B2 * | 6/2004 | Blaha | 439/787 |
| 7,255,592 | B1 * | 8/2007 | Tseng | 439/439 |
| 7,287,999 | B2 * | 10/2007 | Holterhoff et al. | 439/441 |
| 7,384,319 | B2 * | 6/2008 | Kirstein et al. | 439/839 |
| 7,794,268 | B2 * | 9/2010 | Breen et al. | 439/441 |
| 7,976,330 | B2 * | 7/2011 | Lin | 439/353 |
| 7,993,156 | B2 * | 8/2011 | Holste | 439/441 |
| 8,187,023 | B1 * | 5/2012 | Chen | 439/441 |

* cited by examiner

*Primary Examiner* — Amy Cohen Johnson
*Assistant Examiner* — Vladimir Imas

(57) ABSTRACT

A crimpless electrical connector assembly includes an outer housing. The outer housing has a first connector aperture extending therethrough. A connecting member is positionable within the interior of the outer housing. The connecting member insertably receives an electrical conductor so the electrical conductor is operationally coupled to the connecting member. An inner housing is provided. The inner housing has a conductor aperture extending therethrough. The inner housing is positionable within the interior of the outer housing. The conductor aperture is aligned with the first connector aperture when the inner housing is positioned within the interior of the outer housing. The conductor aperture insertably receives the electrical conductor so the electrical conductor is operationally coupled to the connecting member. A connector is selectively inserted into the first connector aperture on the outer housing so the connector is operationally coupled to the connecting member and the electrical conductor.

15 Claims, 4 Drawing Sheets

CRIMPLESS ELECTRICAL CONNECTOR ASSEMBLY

BACKGROUND OF THE DISCLOSURE

Field of the Disclosure

The disclosure relates to crimpless electrical connector devices and more particularly pertains to a new crimpless electrical connector device for splicing two electrical conductors.

SUMMARY OF THE DISCLOSURE

An embodiment of the disclosure meets the needs presented above by generally comprising an outer housing that has a top wall and a perimeter wall coupled to and extending downwardly from the top wall. A bottom edge of the perimeter wall defines an opening to access an interior of the outer housing. The top wall of the outer housing has a first connector aperture extending therethrough. A connecting member is positionable within the interior of the outer housing. The connecting member insertably receives an electrical conductor so the electrical conductor is operationally coupled to the connecting member. The electrical conductor is selectively removable from the connecting member so the connecting member is re-usable. An inner housing has an upper wall, a lower wall and an exterior wall coupled to and extending between the upper and lower walls. The inner housing has a conductor aperture extending through the upper and lower walls. The inner housing is positionable within the interior of the outer housing and frictionally engages the outer housing after the connecting member is positioned with the interior of the outer housing. The conductor aperture is aligned with the first connector aperture when the inner housing is positioned within the interior of the outer housing. The conductor aperture insertably receives the electrical conductor so the electrical conductor is operationally coupled to the connecting member. A connector is selectively inserted into the first connector aperture on the outer housing such that the connector is operationally coupled to the connecting member. The connector is operationally coupled to the electrical conductor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
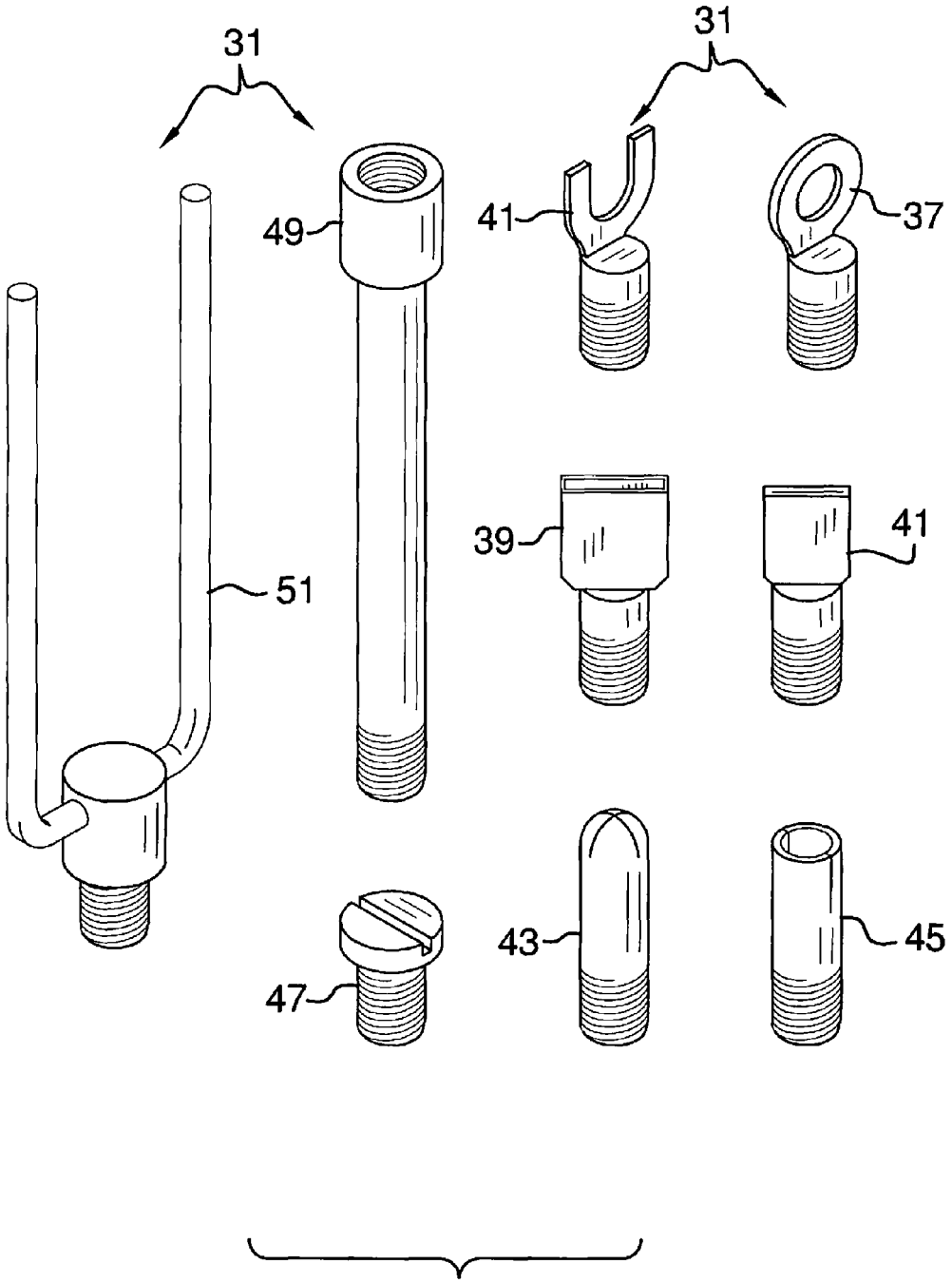
FIG. 1 is a perspective view of a crimpless electrical connector assembly according to an embodiment of the disclosure.
Figure 2:
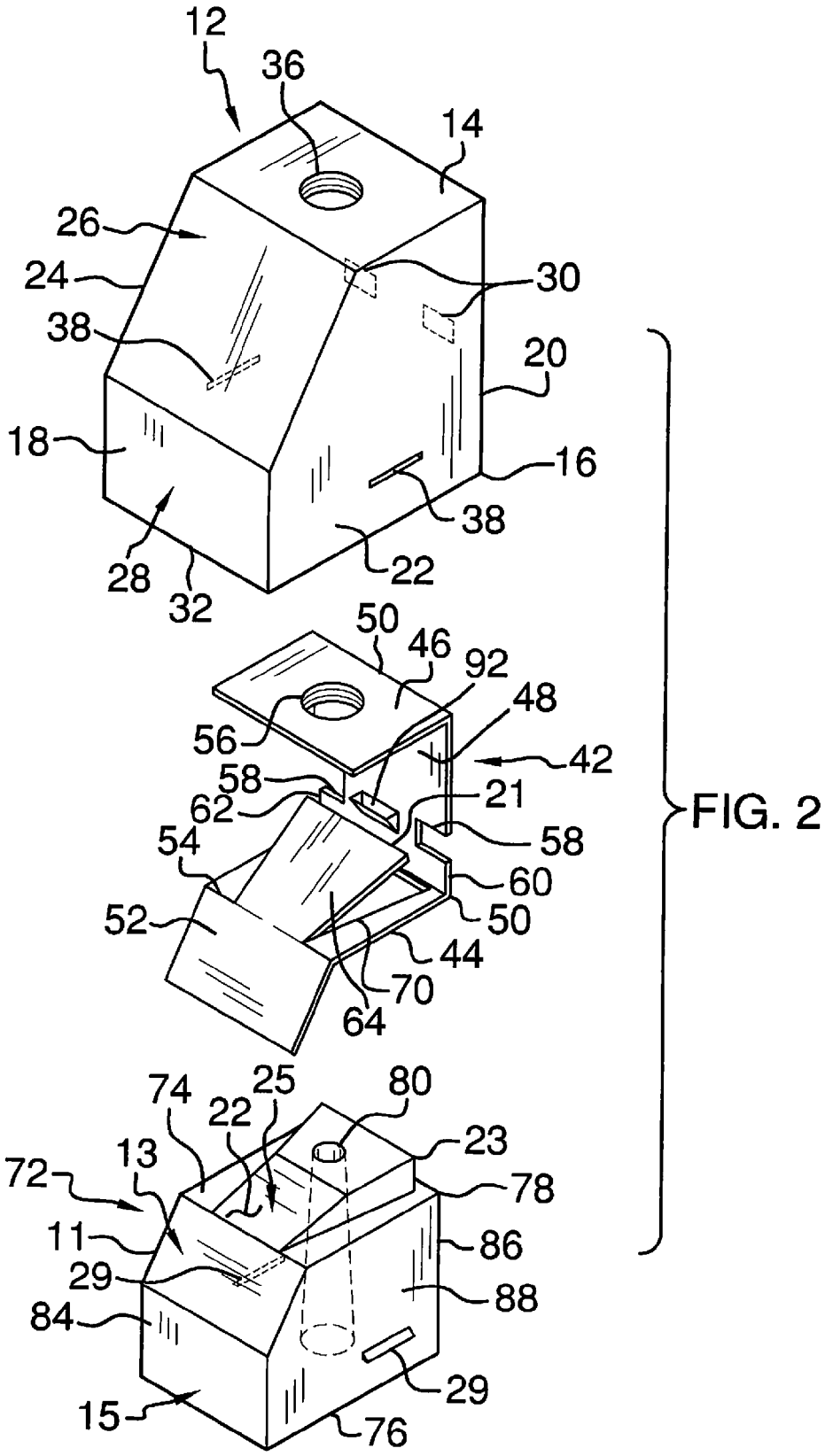
FIG. 2 is a top perspective view of an embodiment of the disclosure.

With reference now to the drawings, and in particular to FIGS. 1 through 5 thereof, a new crimpless electrical connector device embodying the principles and concepts of an embodiment of the disclosure and generally designated by the reference numeral 10 will be described.

As best illustrated in FIGS. 1 through 5, the crimpless electrical connector assembly 10 generally comprises an outer housing 12 that has a top wall 14 and a perimeter wall 16 coupled to and extending downwardly from the top wall 14. The perimeter wall 16 of the outer housing 12 includes a front side 18, a rear side 20, a first lateral side 22 and a second lateral side 24. The front side 18 of the perimeter wall 16 has an angled portion 26 and a vertical portion 28. The angled portion 26 is coupled to and extends between the vertical portion 28 of the front side 18 of the perimeter wall 16 and the top wall 14 of the outer housing 12 at an obtuse angle with respect to the front side 18 and the top wall 14. The outer housing 12 may be comprised of a rigid and electrically insulating material.

The rear side 20 of the perimeter wall 16 of the outer housing 12 has a pair of release apertures 30 extending therethrough. A bottom edge 32 of the perimeter wall 16 defines an opening 34 to access an interior of the outer housing 12. The top wall 14 of the outer housing 12 has a first connector aperture 36 extending therethrough. A pair of slots 38 each extends into an associated inner surface 40 of the first 22 and second 24 lateral sides of the perimeter wall 16 of the outer housing 12.

A connecting member 42 is positionable within the interior of the outer housing 12. The connecting member 42 has a basal wall 44, an upper wall 46 and a rear wall 48 coupled to and extending between a rear edge 50 of each of the basal 44 and upper 46 walls. The connecting member 42 includes a forward wall 52 coupled to and extending downwardly from a leading edge 54 of the basal wall 44 such that the forward wall 52 extends downwardly from the basal wall 44 at an acute angle. The connecting member 42 may be comprised of a rigid and electrically conductive material.

The upper wall 46 of the connecting member 42 has a second connector aperture 56 extending therethrough. The rear wall 48 of the connecting member 42 has a pair of grooves 58 each extending inwardly from an associated one of a first lateral 60 and second lateral 62 edge of the rear wall 48 of the connecting member 42. Each of the grooves 58 aligns with an associated one of the release apertures 30 when the connecting member 42 is positioned within the interior of the outer housing 12. The second connector aperture 56 is aligned with the first connector aperture 36 in the outer housing 12 when the connecting member 42 is positioned within the interior of the outer housing 12.

The forward wall 52 of the connecting member 42 is coplanar with and abuts the angled portion 26 of the perimeter wall 16 of the outer housing 12 when the connecting member 42 is positioned within the interior of the outer housing 12. The upper wall 46 of the connecting member 42 abuts the top wall 14 of the outer housing 12. The rear wall 48 of the connecting member 42 abuts the rear side 20 of the perimeter wall 16 of the outer housing 12 when the connecting member 42 is positioned within the interior of the outer housing 12.

Figure 4:
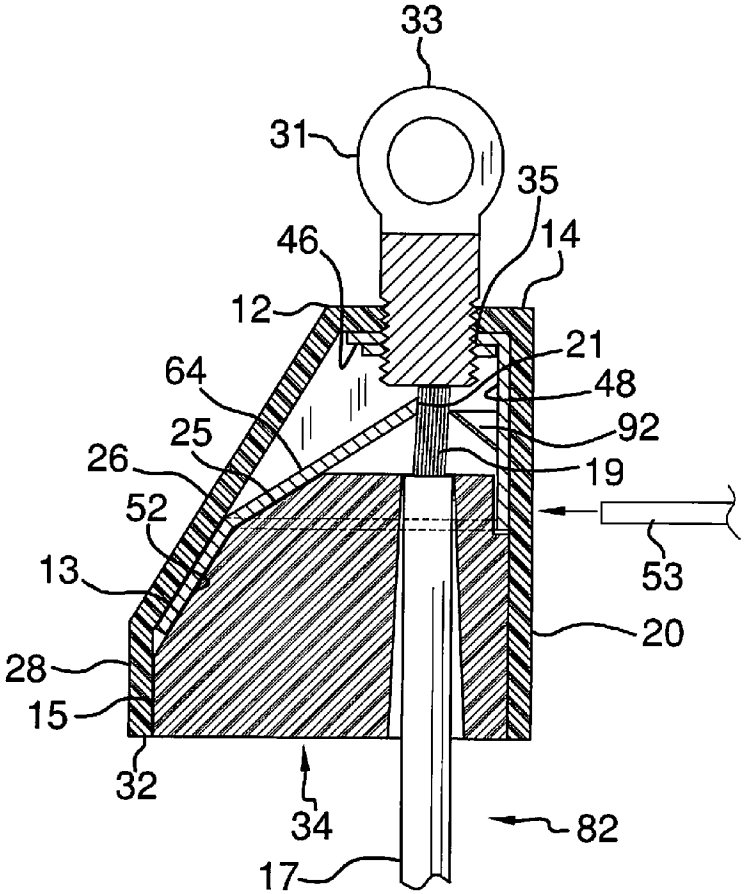
FIG. 4 is a cross sectional view taken along line 4-4 of FIG. 3 of an embodiment of the disclosure.
Figure 3:
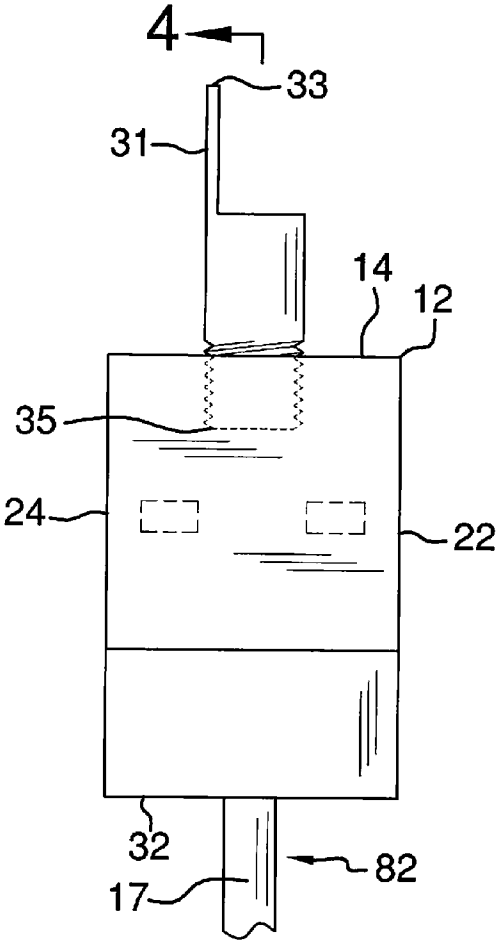
FIG. 3 is a front view of an embodiment of the disclosure.
Figure 5:
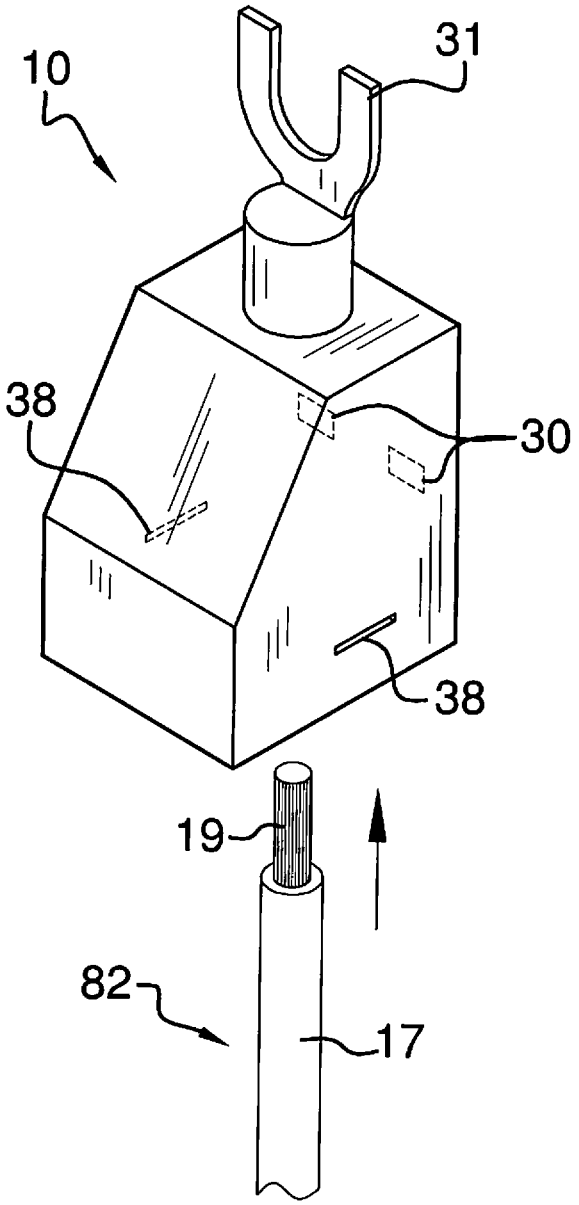
FIG. 5 is a left side perspective view of an embodiment of the disclosure.

The connecting member 42 includes a protrusion 92 extending from the rear wall 48. The protrusion 92 is conductive and contacts a central conductor 19 when the central conductor 19 is inserted into the connector as shown in FIG. 4.

The basal wall 44 of the connecting member 42 includes a tabular portion 64. A forward edge 66 of the tabular portion 64 is coupled to a leading edge 68 of the basal wall 44 of the connecting member 42 so the tabular portion 64 extends upwardly at an acute angle from the basal wall 44 of the connecting member 42. The tabular portion 64 is removed from the basal wall 44 of the connecting member 42 so a conductor opening 70 is defined in the basal wall 44 of the connecting member 42.

An inner housing 72 is positionable within the interior of the outer housing 12 after the connecting member 42 is positioned with the interior of the outer housing 12. The inner housing 72 has an upper wall 74, a lower wall 76 and an exterior wall 78 coupled to and extending between the upper 74 and lower walls 76. The inner housing 72 has a conductor aperture 80 extending through the upper 74 and lower 76 walls. The conductor aperture 80 may insertably receive an electrical conductor 82. The electrical conductor 82 may be of any conventional design. The inner housing 72 may be comprised of a rigid and electrically insulating material.

The exterior wall 78 of the inner housing 72 has a forward side 84, a rearward side 86, a first lateral side 88 and a second lateral side 11. The forward side 84 of the exterior wall 78 of the inner housing 72 has an angled portion 13 and a vertical portion 15. The angled portion 13 of the forward side 84 is coupled to and extends between the vertical portion 15 of the forward side 84 and the upper wall 74 of the inner housing 72. The angled portion 13 of the forward side 84 forms an obtuse angle with respect to the vertical portion 15 of the forward side 84 of the exterior wall 78 and the upper wall 74 of the inner housing 72.

The vertical portion 15 of the forward side 84 of the exterior wall 78 of the inner housing 72 abuts the vertical portion 28 of the front side 18 of the perimeter wall 16 of the outer housing 12 when the inner housing 72 is positioned within the interior of the outer housing 12. The angled portion 13 of the forward side 84 of the exterior wall 78 of the inner housing 72 abuts the forward wall 52 of the connecting member 42 when the inner housing 72 is positioned within the interior of the outer housing 12. The upper wall 74 of the inner housing 72 abuts the basal wall 44 of the connecting member 42 when the inner housing 72 is positioned within the interior of the outer housing 12.

The conductor aperture 80 in the inner housing 72 is positioned beneath the conductor opening 70 and the tabular portion 64 of the connecting member 42 when the inner housing 72 is positioned within the interior of the outer housing 12. A portion of the insulation 17 of the electrical conductor 82 may be removed to reveal the central conductor 19. The electrical conductor 82 may be inserted into the conductor aperture 80 after the connecting member 42 and the inner housing 72 are positioned within the interior of the outer housing 12.

An engaging edge 21 of the tabular portion 64 of the connecting member 42 frictionally engages the exposed central conductor 19 after the electrical conductor 82 is inserted into the conductor aperture 80. The tabular portion 64 of the connecting member 42 retains the electrical conductor 82 in the connecting member 42. The tabular portion 64 places the electrical conductor 82 into electrical communication with the connecting member 42.

The upper wall 74 of the inner housing 72 includes a prominence 23 extending upwardly from the upper wall 74 of the inner housing 72. The prominence 23 extends from the rearward side 86 of the exterior wall 78 to the forward side 84 of the exterior wall 78 such that the conductor aperture 80 extends through the prominence 23. A front portion 25 of the prominence 23 is angled downwardly so an uppermost surface 27 of the front portion 25 meets the upper wall 74 of the inner housing 72. The prominence 23 extends upwardly through the conductor opening 70 in the connecting member 42 when the inner housing 72 is positioned in the interior of the outer housing 12. The front portion 25 of the prominence 23 abuts the tabular portion 64 of the connecting member 42 proximal the forward edge 66 of the tabular portion 64 when the inner housing 72 is positioned in the interior of the outer housing 12.

A pair of tabs 29 each is coupled to an associated one of the first 88 and second 11 lateral sides of the exterior wall 78 of the inner housing 72. Each of the tabs 29 frictionally engages an associated one of the slots 38 on the outer housing 12 when the inner housing 72 is positioned within the interior of the outer housing 12. The tabs 29 retain the inner housing 72 in the outer housing 12. The outer housing 12, connecting member 42 and inner housing 72 may come in a plurality of sizes in order to accommodate a plurality of gauges of electrical conductors 82.

A connector 31 has a top end 33 and a bottom end 35. The bottom end 35 of the connector 31 threadably engages the first connector aperture 36 in the outer housing 12 and the second connector aperture 56 in the connecting member 42. When the connector 31 engages the second connector aperture 56 the connector 31 is electrically coupled to the connecting member 42. The connector 31 is one of a plurality of connectors 31.

The plurality of connectors 31 may comprise a ring connector 37, a female spade connector 39 and a male blade connector 41. Additionally, the plurality of connectors 31 may comprise a plug connector 43, a socket connector 45 and a terminal connector 47. Finally, the plurality of connectors 31 may comprise an extension 49 and a twin plug connector 51. All of the various types of connectors 31 may be provided to be individually selected for an appropriate use.

In use, the appropriate size of outer housing 12, connecting member 42 and inner housing 72 may be selected to correspond to the gauge of the electrical conductor 82. The connecting member 42 and inner housing 72 may be positioned within the interior of the outer housing 12. After the insulation 17 has been removed from the electrical conductor 82, the electrical conductor 82 may be inserted into the conductor aperture 56. The appropriate connector 31 may be selected and inserted into the first connector aperture 36. To remove the electrical conductor 82 from the assembly 10, an object 53 may be inserted into one of the release apertures 30 in the outer housing 12. The object 53 may pass through the grooves 58 on the rear wall 48 of the connecting member 42. The object 53 may urge the tabular portion 64 away from the central conductor 19 so the electrical conductor 82 may be removed from the assembly 10. The assembly 10 may be used repeatedly in the same manner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A crimpless electrical connector assembly configured to be used multiple times, said assembly comprising:

an outer housing having a top wall and a perimeter wall coupled to and extending downwardly from said top wall, a bottom edge of said perimeter wall defining an opening to access an interior of said outer housing, said top wall of said outer housing having a first connector aperture extending therethrough;

a connecting member being positionable within the interior of said outer housing, said connecting member insertably receiving an electrical conductor whereby said electrical conductor is operationally coupled to said connecting member, the electrical conductor being selectively removable from said connecting member whereby said connecting member is re-usable;

an inner housing having an upper wall, a lower wall and an exterior wall coupled to and extending between said upper and lower walls, said inner housing having a conductor aperture extending through said upper and lower walls, said inner housing being positionable within the interior of said outer housing and frictionally engaging said outer housing after said connecting member is positioned with the interior of said outer housing, said conductor aperture being aligned with said first connector aperture when said inner housing is positioned within the interior of said outer housing, said conductor aperture insertably receiving the electrical conductor whereby said electrical conductor is operationally coupled to said connecting member;

a connector being selectively inserted into said first connector aperture on said outer housing such that said connector is operationally coupled to said connecting member whereby said connector is operationally coupled to the electrical conductor;

said perimeter wall of said outer housing including a front side and rear side;

said front side of said perimeter wall having an angled portion and a vertical portion;

said connecting member having a basal wall, an upper wall and a rear wall coupled to and extending between a rear edge of each of said basal and upper walls, said connecting member including a forward wall coupled to and extending downwardly from a leading edge of said basal wall such that said forward wall extends downwardly from said basal wall at an acute angle, said forward wall being co-planar with and abutting said angled portion of said perimeter wall of said outer housing when said connecting member is positioned within the interior of said outer housing, said upper wall abutting said top wall of said outer housing and said rear wall abutting said rear side of said perimeter wall of said outer housing when said connecting member is positioned within the interior of said outer housing.

2. The assembly according to claim 1, further including said perimeter wall of said outer housing including a front side, a rear side, a first lateral side and a second lateral side, said front side of said perimeter wall having an angled portion and a vertical portion, said angled portion being coupled to and extending between said vertical portion of said front side of said perimeter wall and said top wall of said outer housing at an obtuse angle with respect to said front side and said top wall.

3. The assembly according to claim 2, further including a pair of slots each extending into an associated inner surface of said first and second lateral sides of said perimeter wall of said outer housing.

4. The assembly according to claim 2, further including said rear side of said perimeter wall of said outer housing having a pair of release apertures extending therethrough.

5. The assembly according to claim 1, further including said upper wall of said connecting member having a second connector aperture extending therethrough, said second connector aperture being aligned with said first connector aperture in said outer housing when said connecting member is positioned within the interior of said outer housing.

6. The assembly according to claim 1, further including said basal wall of said connecting member including a tabular portion, a forward edge of said tabular portion being coupled to a leading edge of said basal wall of said connecting member such that said tabular portion extends upwardly at an acute angle from said basal wall of said connecting member, said tabular portion being removed from said basal wall of said connecting member whereby a conductor opening is defined in said basal wall of said connecting member.

7. The assembly according to claim 1, further including:

said rear side of said perimeter wall of said outer housing having a pair of release apertures extending therethrough;

said rear wall of said connecting member having a pair of grooves each extending inwardly from an associated one of a first lateral and second lateral edge of said rear wall of said connecting member, each of said grooves aligning with an associated one of said release apertures when said connecting member is positioned within the interior of said outer housing.

8. The assembly according to claim 1, further including said exterior wall of said inner housing having a forward side, a rearward side, a first lateral side and a second lateral side, said forward side of said exterior wall of said inner housing having an angled portion and a vertical portion, said angled portion of said forward side being coupled to and extending between said vertical portion of said forward side and said upper wall of said inner housing at an obtuse angle with respect to said vertical portion of said forward side of said exterior wall and said upper wall of said inner housing.

9. The assembly according to claim 8, further including said upper wall of said inner housing including a prominence extending upwardly from said upper wall of said inner housing, said prominence extending from said rearward side of said exterior wall to said forward side of said exterior wall such that said conductor aperture extends through said prominence, a front portion of said prominence being angled downwardly such that said an uppermost surface of said front portion meets said upper wall of said inner housing.

10. The assembly according to claim 8, further including:

a pair of slots each extending into an associated inner surface of said first and second lateral sides of said perimeter wall of said outer housing;

a pair of tabs each being coupled to an associated one of said first and second lateral sides of said exterior wall of said inner housing, each of said tabs frictionally engaging an associated one of said slots on said outer housing when said inner housing is positioned within the interior of said outer housing whereby said inner housing is retained in said outer housing.

11. The assembly according to claim 1, further including:

said exterior wall of said inner housing having a forward side, a rearward side, a first lateral side and a second lateral side;

said forward side of said exterior wall of said inner housing having an angled portion and a vertical portion;

said vertical portion of said forward side of said exterior wall of said inner housing abutting said vertical portion of front side of said perimeter wall of said outer housing when said inner housing is positioned within the interior of said outer housing, said angled portion of said forward side of said exterior wall of said inner housing abutting said forward wall of said connecting member when said inner housing is positioned within the interior of said outer housing, said upper wall of said inner housing abutting said basal wall of said connecting member when said inner housing is positioned within the interior of said outer housing.

12. The assembly according to claim 6, further including said conductor aperture in said inner housing being positioned beneath said conductor opening and said tabular portion of said connecting member when said inner housing is positioned within the interior of said outer housing, said tabular portion of said connecting member frictionally engaging the electrical conductor after the electrical conductor is inserted into said conductor aperture whereby the electrical conductor is retained in and placed into electrical communication with said connecting member.

13. The assembly according to claim 5, further including said connector having a top end and a bottom end, said bottom end of said connector threadably engaging said first connector aperture in said outer housing and said second connector aperture in said connecting member whereby said connector is electrically coupled to said connecting member.

14. The assembly according to claim 1, further including said connector being one of a plurality of said connectors.

15. A crimpless electrical connector assembly configured to be used multiple times, said assembly comprising:

an outer housing having a top wall and a perimeter wall coupled to and extending downwardly from said top wall, said perimeter wall of said outer housing including a front side, a rear side, a first lateral side and a second lateral side, said front side of said perimeter wall having an angled portion and a vertical portion, said angled portion being coupled to and extending between said vertical portion of said front side of said perimeter wall and said top wall of said outer housing at an obtuse angle with respect to said front side and said top wall, said rear side of said perimeter wall of said outer housing having a pair of release apertures extending therethrough, a bottom edge of said perimeter wall defining an opening to access an interior of said outer housing, said top wall of said outer housing having a first connector aperture extending therethrough;

a pair of slots each extending into an associated inner surface of said first and second lateral sides of said perimeter wall of said outer housing;

a connecting member being positionable within the interior of said outer housing, said connecting member having a basal wall, an upper wall and a rear wall coupled to and extending between a rear edge of each of said basal and upper walls, said connecting member including a forward wall coupled to and extending downwardly from a leading edge of said basal wall such that said forward wall extends downwardly from said basal wall at an acute angle, said upper wall of said connecting member having a second connector aperture extending therethrough, said rear wall of said connecting member having a pair of grooves each extending inwardly from an associated one of a first lateral and second lateral edge of said rear wall of said connecting member, each of said grooves aligning with an associated one of said release apertures when said connecting member is positioned within the interior of said outer housing, said second connector aperture being aligned with said first connector aperture in said outer housing when said connecting member is positioned within the interior of said outer housing, said forward wall being co-planar with and abutting said angled portion of said perimeter wall of said outer housing when said connecting member is positioned within the interior of said outer housing, said upper wall abutting said top wall of said outer housing and said rear wall abutting said rear side of said perimeter wall of said outer housing when said connecting member is positioned within the interior of said outer housing, said basal wall of said connecting member including;

a tabular portion, a forward edge of said tabular portion being coupled to a leading edge of said basal wall of said connecting member such that said tabular portion extends upwardly at an acute angle from said basal wall of said connecting member, said tabular portion being removed from said basal wall of said connecting member whereby a conductor opening is defined in said basal wall of said connecting member;

an inner housing being positionable within the interior of said outer housing after said connecting member is positioned with the interior of said outer housing, said inner housing having an upper wall, a lower wall and an exterior wall coupled to and extending between said upper and lower walls, said inner housing having a conductor aperture extending through said upper and lower walls, said exterior wall of said inner housing having a forward side, a rearward side, a first lateral side and a second lateral side, said forward side of said exterior wall of said inner housing having an angled portion and a vertical portion, said angled portion of said forward side being coupled to and extending between said vertical portion of said forward side and said upper wall of said inner housing at an obtuse angle with respect to said forward side of said vertical portion of said exterior wall and said upper wall of said inner housing, said vertical portion of said forward side of said exterior wall of said inner housing abutting said vertical portion of front side of said perimeter wall of said outer housing when said inner housing is positioned within the interior of said outer housing, said angled portion of said forward side of said exterior wall of said inner housing abutting said forward wall of said connecting member when said inner housing is positioned within the interior of said outer housing, said upper wall of said inner housing abutting said basal wall of said connecting member when said inner housing is positioned within the interior of said outer housing, said conductor aperture in said inner housing being positioned beneath said conductor opening and said tabular portion of said connecting member when said inner housing is positioned within the interior of said outer housing, said tabular portion of said connecting member frictionally engaging the electrical conductor after the electrical conductor is inserted into said conductor aperture whereby the electrical conductor is retained in and placed into electrical communication with said connecting member, said upper wall of said inner housing including;

a prominence extending upwardly from said upper wall of said inner housing, said prominence extending from said rearward side of said exterior wall to said forward side of said exterior wall such that said conductor aperture extends through said prominence, a front portion of said prominence being angled downwardly such that said an uppermost surface of said front portion meets said upper wall of said inner housing;

a pair of tabs each being coupled to an associated one of said first and second lateral sides of said exterior wall of said inner housing, each of said tabs frictionally engaging an associated one of said slots on said outer housing when said inner housing is positioned within the interior of said outer housing whereby said inner housing is retained in said outer housing; and a connector having a top end and a bottom end, said bottom end of said connector threadably engaging said first connector aperture in said outer housing and said second connector aperture in said connecting member whereby said connector is electrically coupled to said connecting member, said connector being one of a plurality of said connectors.

* * * * *